US005562986A

United States Patent [19]

Yamamoto et al.

[11] Patent Number: 5,562,986

[45] Date of Patent: Oct. 8, 1996

[54] POLYTETRAFLUOROETHYLENE FIBERS, POLYTETRAFLUOROETHYLENE MATERIALS AND PROCESS FOR PREPARATION OF THE SAME

[75] Inventors: Katsutoshi Yamamoto; Osamu Tanaka; Osamu Inoue; Toshio Kusumi; Shinichi Chaen; Jun Asano; Nobuki Uraoka, all of Settsu, Japan

[73] Assignee: Daikin Industries, Ltd., Osaka, Japan

[21] Appl. No.: 347,385

[22] PCT Filed: Apr. 4, 1994

[86] PCT No.: PCT/JP94/00553

§ 371 Date: Jan. 5, 1995

§ 102(e) Date: Jan. 5, 1995

[87] PCT Pub. No.: WO94/23098

PCT Pub. Date: Oct. 13, 1994

[30] Foreign Application Priority Data

Apr. 5, 1993 [JP] Japan ..... 5-078264

[51] Int. Cl.[6] ..... D02G 3/00

[52] U.S. Cl. ..... 428/364; 428/397; 428/399; 264/160; 264/147

[58] Field of Search ..... 428/399, 364, 428/398, 397; 264/127, 160, 147

[56] References Cited

U.S. PATENT DOCUMENTS

| | | | |
|---|---|---|---|
| 3,513,144 | 5/1970 | Kometuni | 428/364 |
| 3,864,124 | 2/1975 | Breton et al. | 264/59 |
| 4,082,893 | 4/1978 | Okita | 428/398 |
| 4,194,040 | 3/1980 | Breton et al. | 264/122 |
| 4,361,619 | 11/1982 | Forsten et al. | 428/234 |
| 4,482,516 | 11/1984 | Bowman et al. | 264/127 |
| 4,598,011 | 7/1986 | Bowman | 521/145 |
| 5,030,403 | 7/1991 | Pickens et al. | 264/127 |
| 5,308,664 | 5/1994 | House et al. | 428/398 |

FOREIGN PATENT DOCUMENTS

| | | |
|---|---|---|
| 50-22651 | 3/1975 | Japan . |
| 58-158442 | 9/1983 | Japan . |
| 58-180621 | 10/1983 | Japan . |
| 35093 | 7/1989 | Japan . |
| 2-286220 | 11/1990 | Japan . |
| 1531720 | 11/1978 | United Kingdom . |

*Primary Examiner*—N. Edwards
*Attorney, Agent, or Firm*—Varndell Legal Group

[57] ABSTRACT

Cotton-like polytetrafluoroethylene materials are obtained by opening a uniaxially stretched article of molded polytetrafluoroethylene by a mechanical force. Those cotton-like materials comprise the 5 to 150 mm long fibers having branches and crimps and non-uniform section. The cotton-like materials are excellent in intermingling property and can be easily made into non-woven fabrics.

18 Claims, 14 Drawing Sheets

POLYTETRAFLUOROETHYLENE FIBERS, POLYTETRAFLUOROETHYLENE MATERIALS AND PROCESS FOR PREPARATION OF THE SAME

TECHNICAL FIELDS

The present invention relates to novel polytetrafluoroethylene (PTFE) fibers excellent in intermingling property, cotton-like materials containing those fibers and a process for preparation thereof.

BACKGROUND ARTS

In recent years, non-woven fabrics comprising synthetic fibers, by making the best use of characteristics of those fibers, are extending their applications into various fields, such as clothing materials, medical materials, engineering and building materials, and materials for industrial use.

Among them, non-woven fabrics containing PTFE fibers are excellent in heat resistance, chemical resistance and abrasion resistance, and are expected to be further developed as highly functional non-woven fabrics.

Cotton-like PTFE materials being made into the non-woven fabrics are gathered PTFE fibers, and so far have been made in such manners as mentioned below:

(1) A process for producing filaments and then cutting to a desired length.

The process for producing PTFE filaments is roughly classified into the following two processes.

(1a) An emulsion spinning method disclosed U.S. Pat. No. 2,772,444. This method comprises extrusion spinning of a viscose binder, and the like containing PTFE particles, and then sintering to obtain the filaments having a circular section. Major problems of that method are such that a binder remains as a carbonaceous residual after sintering, the obtained PTFE filaments are colored in a dark brown, and that even if the carbonaceous residual is oxidized to be discolored, an original purity cannot be maintained.

(1b) A method disclosed in JP-B-22915/1961 or JP-B-8769/1973. This method comprises stretching of fibers obtained by slitting a PTFE film to a desired width. A problem of this method is that the smaller the slit width is, the more easily the fibers are broken at the time of stretching.

Both PTFE fibers obtained by the methods (1a) and (1b) have a low friction coefficient and a high specific gravity inherent to the PTFE, and therefore are not intermingled sufficiently with each other even if having been crimped. (JP-B-22621/1975)

(2) A process for preparing PTFE fibrous powder in the form of a pulp and making a sheet-like material therefrom by paper making process (U.S. Pat. No. 3,003,912 and JP-B-15906/1969).

The method of the above-mentioned U.S. patent is to cut PTFE rod obtained by a paste extrusion, to a short length and to apply a shearing force to obtain fibrous PTFE powder.

JP-B-15906/1969 discloses a method for making fibers by applying a shearing force to the PTFE powder.

Any of the fibrous powder obtained by the above-mentioned methods can be made up to a sheet-like material by paper making process but cannot be made into a non-woven fibric by the use of a carding machine, needle punching machine, or the like as they are short in fiber length and in the form of a pulp.

An object of the present invention is to provide the PTFE fibers excellent in intermingling property and cotton-like materials containing those fibers.

Another object of the present invention is to provide a process for obtaining cotton-like PTFE materials, which are staple fibers (relatively short fibers), directly from a uniaxially stretched long film of PTFE, without making multifilaments (a large number of continuous fibers).

DISCLOSURE OF THE INVENTION

The present invention relates to the PTFE fibers and the cotton-like materials containing those fibers, which can be obtained by opening a uniaxially stretched article of molded PTFE by a mechanical force.

It is preferable that the length of the PTFE fiber of the present invention is 5 to 150 min.

It is also preferable that the PTFE fibers of the present invention have a branched structure, fineness of the fibers is 2 to 200 deniers, the number of crimps is 1 to 15/20 mm and a section of the fibers is not uniform.

In the present invention, the shape of the section being not uniform means that the shape of the section of the fibers has no regularity and differs from S each other, and it can be said in more detail that the section of the fiber of the present invention has rather few complicated unevenness, and in most cases, is square-shaped and is in a shape resembling a cracked stone. There are many cases where flat fibers as shown in FIG. 13 (×50) are contained in a large ratio, though it is actually dependent upon production conditions. The ratio of such flat fibers becomes high as a thickness of a stretched film becomes thinner.

Also it is preferable that the molded PTFE which is the starting material is a semi-sintered or sintered one.

The present invention also relates to the cotton-like PTFE materials containing not less than 30% of the PTFE fibers of the present invention.

The present invention also relates to a process for preparing the cotton-like PTFE materials which are obtained by uniaxially stretching the molded PTFE and opening the uniaxially stretched article by a mechanical force.

The molded PTFE to be stretched is preferably a semi-sintered one or a sintered one. In case of the semi-sintered one, a stretching ratio in a longitudinal direction of the film is preferably at least 6 times, and in case of the sintered one, preferably at least 3 times.

As the methods for opening by a mechanical force, preferable are the method to bring the uniaxially stretched film, which was obtained by stretching the sintered PTFE by at least 6 times, into contact with sharp projections located on an outer surface of a cylindrical drum rotating at high speed, or the method to pass the uniaxially stretched film, which was obtained by stretching the sintered PTFE by at least 3 times, between at least a pair of needle blade rolls rotating at high speed. In the latter method, the number of needles of the roll is preferably 20 to 100/cm$^2$.

Also it is preferable to heat-treat the uniaxially stretched film of the semi-sintered or sintered PTFE, at a temperature higher than that at the time of stretching.

PREFERRED EMBODIMENTS OF THE INVENTION

As the molded PTFE used in the present invention, there are, for example, those obtained with a paste extrusion molding of PTFE fine powder (PTFE fine powder obtained by an emulsion polymerization) or those obtained with a compression molding of PTFE molding powder (PTFE powder obtained by a suspension polymerization). The molded PTFE are preferably in such a form as film, tape, sheet and ribbon. A thickness thereof is 5 to 300 preferably 5 to 150 μm in order to conduct a stable stretching. A PTFE film can be obtained by calendering the extrudate molded by paste extrusion of PTFE fine powder or cutting a compression-molded powder.

The molded PTFE to be uniaxially stretched is preferably semi-sintered or sintered one. The semi-sintered PTFE is obtained by heat-treating the unsintered PTFE at a temperature between the melting point (about 327° C.) of the sintered PTFE and the melting point (about 337° to about 347° C.) of the unsintered PTFE. A crystalline conversion ratio of the semi-sintered PTFE is 0.10 to 0.85, preferably 0.15 to 0.70.

The crystalline conversion of the semi-sintered PTFE article is determined as follows:

10.0±0.1 mg of a sample of the semi-sintered PTFE is prepared. Since the sintering proceeds from the surface toward the inner portion, the degree of the semi-sintering of the article is not necessarily homogeneous throughout the article, and the semi-sintering is less homogeneous in a thicker article than in a thinner one. In the preparation of the sample, it is, therefore, to be noted that various portions having various degrees of semi-sintering must be sampled uniformly. With thus prepared sample, at first the crystalline melting chart is made in the following method.

The crystalline melting chart is recorded by means of a differential scanning carolimeter (hereinafter referred to as "DSC", for example DSC-2 of Perkin-Elmer). First the sample of the unsintered PTFE is charged in an aluminum-made pan of the DSC, and the heat of fusion of the unsintered PTFE and that of the sintered PTFE are measured as follows:

(1) The sample is heated at a heating rate of 160° C./min. to 277° C. and then at a heating rate of 10° C./min from 277° C. to 360° C.

Figure 14:
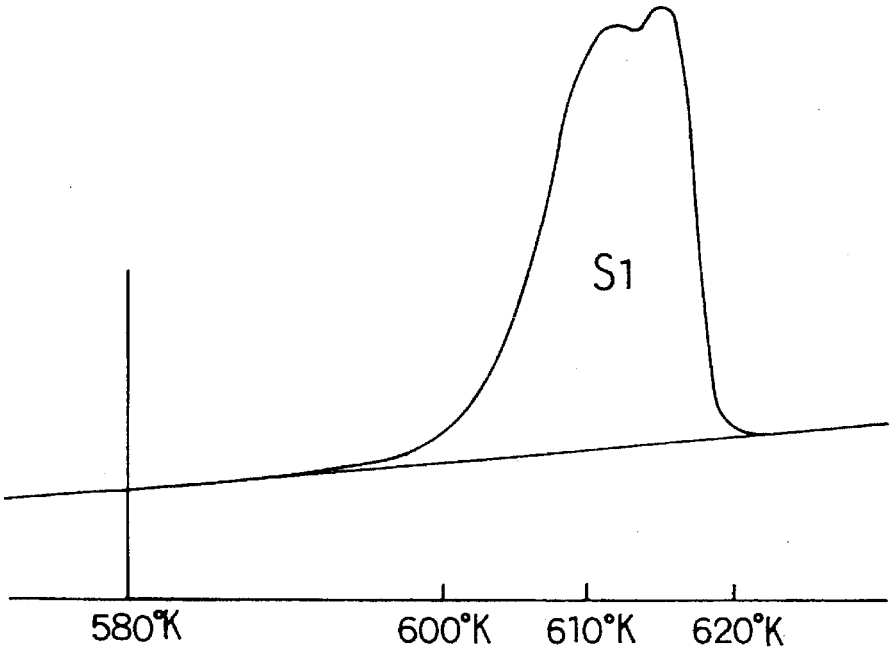
FIG. 14 is an example of a crystalline melting curve obtained from a differential scanning calorimeter (hereinafter referred to as "DSC") in a heating process (1) of an unsintered PTFE, which is used for measuring a crystalline conversion ratio of a semi-sintered PTFE.

An example of a crystalline melting chart recorded during this heating step is shown in FIG. 14. A position where an endothermic curve appears in this step is defined as "a melting point of the unsintered PTFE or PTFE fine powder".

(2) Immediately after heating to 360° C. the sample is cooled at a cooling rate of 80° C./min. to 277° C., and (3) again the sample is heated at a heating rate of 10° C./min. to 360° C.

Figure 15:
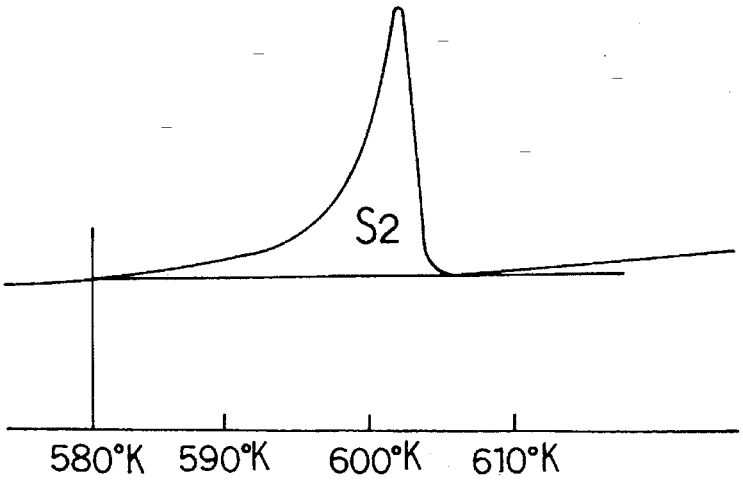
FIG. 15 is an example of a crystalline melting curve of the DSC in a heating process (3) of a sintered PTFE, which is used for measuring a crystalline conversion ratio of a semi-sintered PTFE.

An example of a crystalline melting chart recorded during the heating step (3) is shown in FIG. 15. A position where an endothermic curve appears in the heating step (3) is defined as "a melting point of the sintered PTFE".

The heat of fusion of the unsintered or sintered PTFE is proportional to the area between the endothermic curve and a base line which is drawn from a point on the DSC chart at 307° C. (580° K.) and tangential with the curve at the right-hand foot of the endothermic curve.

Figure 16:
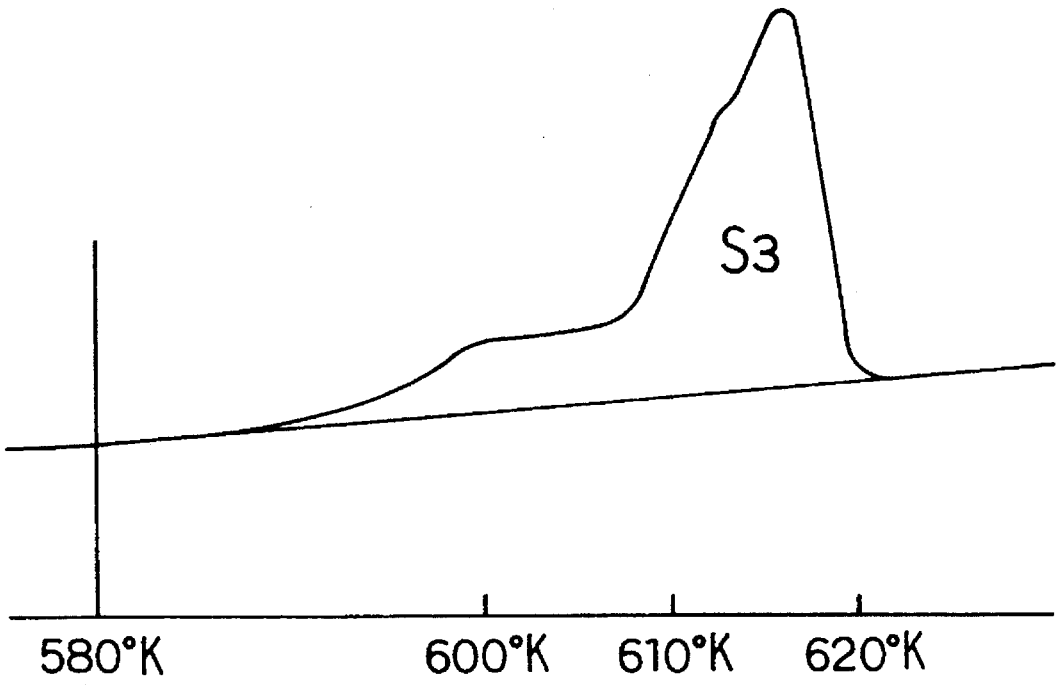
FIG. 16 is an example of a crystalline melting curve of the DSC in a heating process of a semi-sintered PTFE, which is used for measuring a crystalline conversion ratio of a semi-sintered PTFE.

Secondly, a crystalline melting chart for the semi-sintered PTFE is recorded following the step (1), an example of which chart is shown in FIG. 16.

Then, the crystalline conversion is defined by the following equation:

$$\text{Crystalline conversion}=(S_1-S_3)/(S_1-S_2)$$

wherein $S_1$ is the area of the endothermic curve of the unsintered PTFE (cf. FIG. 14), $S_2$ is the area of the endothermic curve of the sintered PTFE (cf. FIG. 15) and $S_3$ is the area of the endothermic curve of the semi-sintered PTFE (cf. FIG. 16).

The crystalline conversion of the semi-sintered PTFE article of the invention is from 0.10 to 0.85, preferably from 0.15 to 0.70.

The sintered PTFE can be obtained by heat-treating the unsintered PTFE or semi-sintered PTFE at a temperature of not less than the melting point of the unsintered PTFE.

The uniaxial stretching of the present invention can be carried out by the conventional methods such as stretching between the two rolls which have been heated to usually about 250° to 320° C. and have different rotation speed. The stretching ratio is preferably changed depending on the degree of sintering, and is at least 6 times, preferably not less than 10 times in case of the semi-sintered PTFE, and at least 3 times, preferably not less than 3.5 times in case of the sintered PTFE. This is because the orientation is necessary to be increased by stretching since the tearing property of the semi-sintered PTFE in the longitudinal direction is worse as compared to that of the sintered PTFE. Also in order to obtain fine fibers, it is desirable to stretch by as high ratio as possible, but the attainable stretching ratio is usually about 10 times in case of the sintered PTFE, and about 30 times in case of the semi-sintered PTFE.

In case of a too low stretching ratio, there is produced by any mechanical force, a ribbon-like wide article which cannot be called a fiber, and also there occurs a trouble that the film is intermingled with the projections of the opening machine and the needle blades because there still remains an allowance of stretching.

In case of the semi-sintered PTFE and the sintered PTFE, an additional heat treating after the uniaxial stretching can prevent the shrinkage, due to a heat, of the fiber obtained after opening, maintain bulkiness of the cotton-like materials, and prevent air permeability. The heat treating temperature is usually not less than 300° C.

The so-obtained semi-sintered or sintered PTFE film uniaxially stretched is opened by a mechanical force.

The mechanical force to be applied for opening may be basically the one enough to open by tearing the uniaxially stretched article of the molded PTFE. There are, for example, the following means for opening.

(1) A cylindrical drum having sharp projections thereon is rotated at high speed and the film obtained by uniaxially stretching the molded PTFE is brought into contact with the mentioned projections for tearing to open (e.g. JP-B-35093/1989).

(2) The uniaxially stretched article of the molded PTFE is passed between at least a pair of needle blades rolls rotating at high speed for tearing to open (e.g. JP-A-180621/1983).

The means (1) is suitable for the semi-sintered PTFE, in the case of the sintered PTFE, a wide tape-like article is liable to be produced though the reason is not clear. The preferred embodiment of the means (1) is explained in accordance with FIG. 2.

Figure 2:
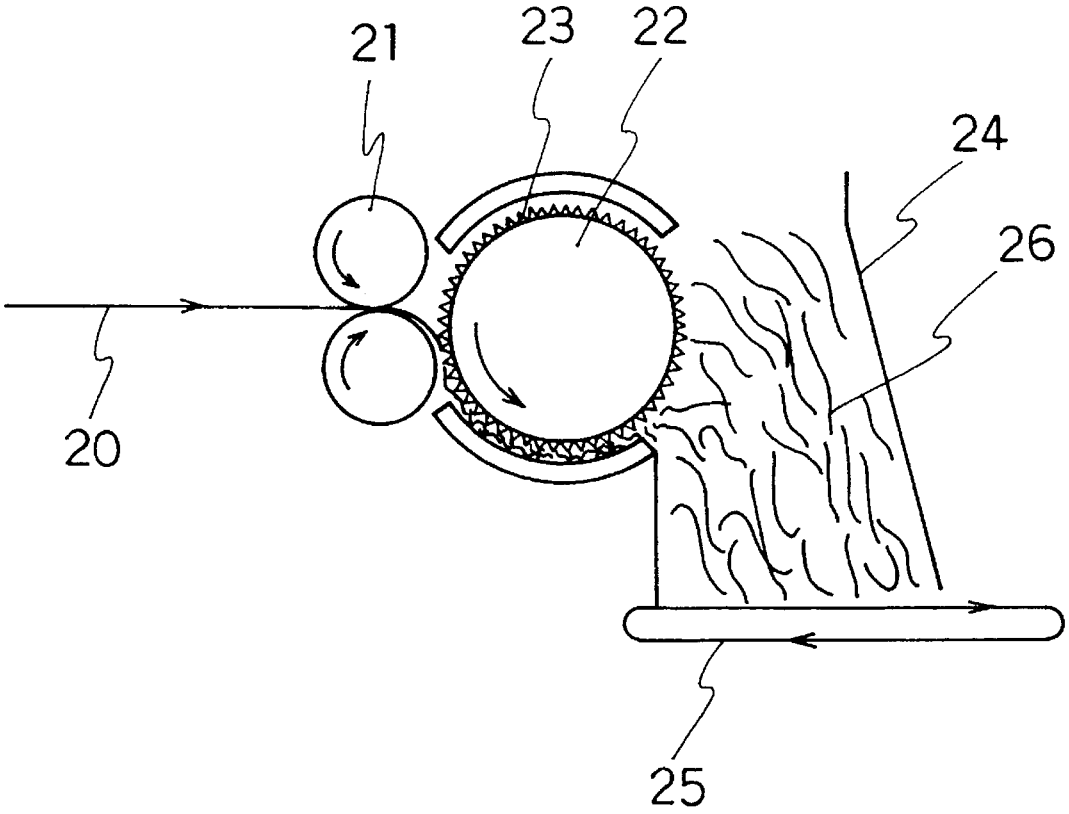
FIG. 2 is a diagrammatic sectional view of the Example of an opening machine which can be used in the process for preparation of the present invention.

In FIG. 2, the number 20 is a uniaxially stretched film of a molded PTFE, which is fed toward the roll 22 by means of the pinch roll 21. On the outer surface of the roll 22, there is formed the projection 23. Such a projection can be made, for example, by winding a garnet wire on the roll. The hood 24 is provided at the rear side of the roll 22, and the feed belt 25 is arranged under the hood 24.

The uniaxially stretched film 20 of the molded PTFE is fed toward the roll 22 by means of the pinch roll 21 at a constant feed speed. The roll 22 is rotated at high speed. The film 20 is brought into contact with the garnet wire on the roll, torn and opened and then discharged toward the rear side of the roll 22. The inside of the hood 24 is under the pressure-reduced condition at the portion near the feed belt 25, and therefore the opened fiber 26 coming out from the roll 22 drops onto the belt 25 and piles thereon. The film feed speed is usually about 0.1 to 10 m/min., preferably about 0.1 to 5 m/min., and the peripheral speed of the roll 22 is about 200 to 2000 m/min., preferably 400 to 1500 m/min.

The means (2) is suitable for the sintered PTFE uniaxially stretched film (including a film which is sintered at a temperature of not less than the melting point of the unsintered PTFE after uniaxially stretching of the semi-sintered film). In the case of the semi-sintered PTFE film, a PTFE fiber is liable to be entangled on the needle blades of the roll while in the case of the uniaxially stretched film of the sintered PTFE, such an entanglement does not occur. The preferred embodiment of the means (2) is explained in accordance with FIG. 3.

Figure 3:
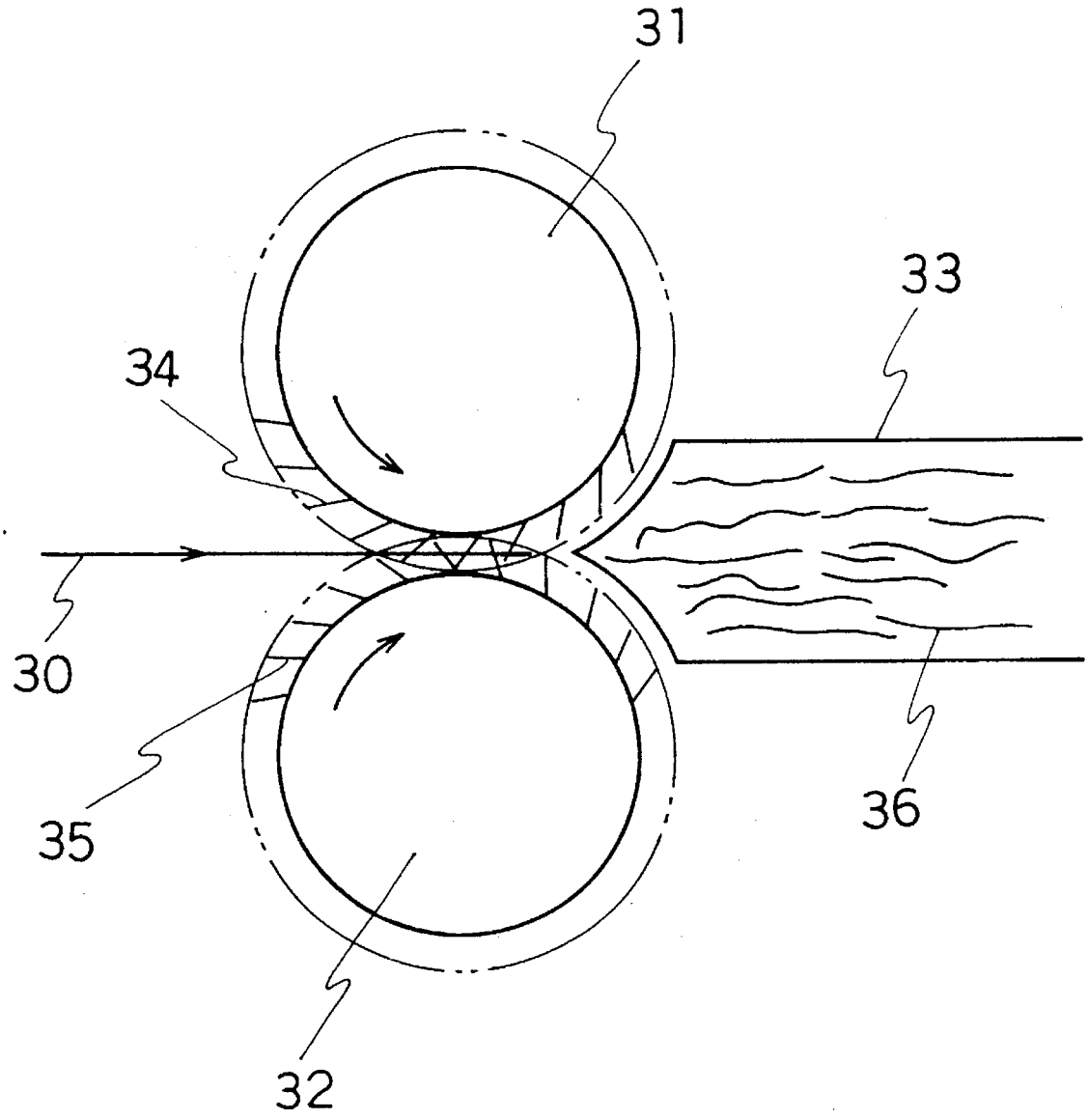
FIG. 3 is a diagrammatic sectional view of another Example of an opening machine which can be used in the process for preparation of the present invention.

In FIG. 3, the number 30 is a uniaxially stretched film of the sintered PTFE, which is fed to a pair of the needle blade rolls 31 and 32 by means of a transfer means (not illustrated). At the rear side of the rolls 31 and 32, there is provided the pipe 33, and the inside of the pipe is under pressure-reduced condition. The film 30 passes between the needle blade rolls 31 and 32, and during passing therebetween, the film is torn and opened with the needle blades 34 and 35 provided on the outer surfaces of the needle blade rolls 31 and 32. The cut fibers 36 are collected in the pressure-reduced pipe 33 to be in the form of cotton-like materials (not illustrated).

The relation of the unixially stretched film feed speed (v3) and the needle blade rotation speed (peripheral speed (v4)) is shown by v4>v3.

The arrangement, the number, the length, the diameter and the angle of needle blades 34 and 35 of the needle blade rolls 31 and 32 may be properly determined in consideration of a thickness of the fibers intended to be obtained. It is preferable that the blades are usually arranged at a row in the longitudinal direction of the roll, the number of blades is 20 to 100/cm$^2$ and the angle of needles is 50° to 70°, but the arrangement, the number and the angle are not limited thereto. Also the mounted conditions of the needle blades of the rolls 31 and 32 may be the same or different. The distance between the needle blade rolls 31 and 32 may also be properly adjusted. The preferable distance is usually such that the needles overlap by about 1 to 5 mm at the end thereof.

Thus obtained cotton-like PTFE material of the present invention though the external appearance thereof looks like natural cotton wool, are gathered PTFE fibers. The fibers differ in length and form from each other, and the cotton-like materials are mainly composed of the branched fibers (The content thereof is not less than 30%, preferably not less than 50%, more preferably not less than 70%).

The cotton-like PTFE materials of the present invention can be called an aggregate of relatively short fibers, so-called PTFE staple fibers.

The length of the fibers of the cotton-like PTFE materials varies with the production conditions, and ranges from about 1 mm to about 250 mm.

Because short fibers are lacking in intermingling property and long fibers are disadvantageous in dividing slivers, the preferable fiber length is 5 to 150 mm, specifically 25 to 150 min.

The content of the fibers having the preferable length in the cotton-like materials is not less than 30%, preferably not less than 50%, more preferably not less than 70% from a viewpoint of intermingling property. When the ratio is in the range as mentioned above, there can be minimized such a trouble as a blockage between the needles of a carding machine.

Also it is particularly preferable that the fibers of the present invention have a branched structure, fineness thereof is 2 to 200 deniers, preferably 2 to 50 deniers, the number of crimps is 1 to 15/20 mm, and the figure of section of the fibers is not uniform. Such fibers, of which content is not less than about 30%, particularly not less than about 50% of the total of the cotton-like materials, are preferable from a viewpoint of processability to the non-woven fabrics.

Figure 1:
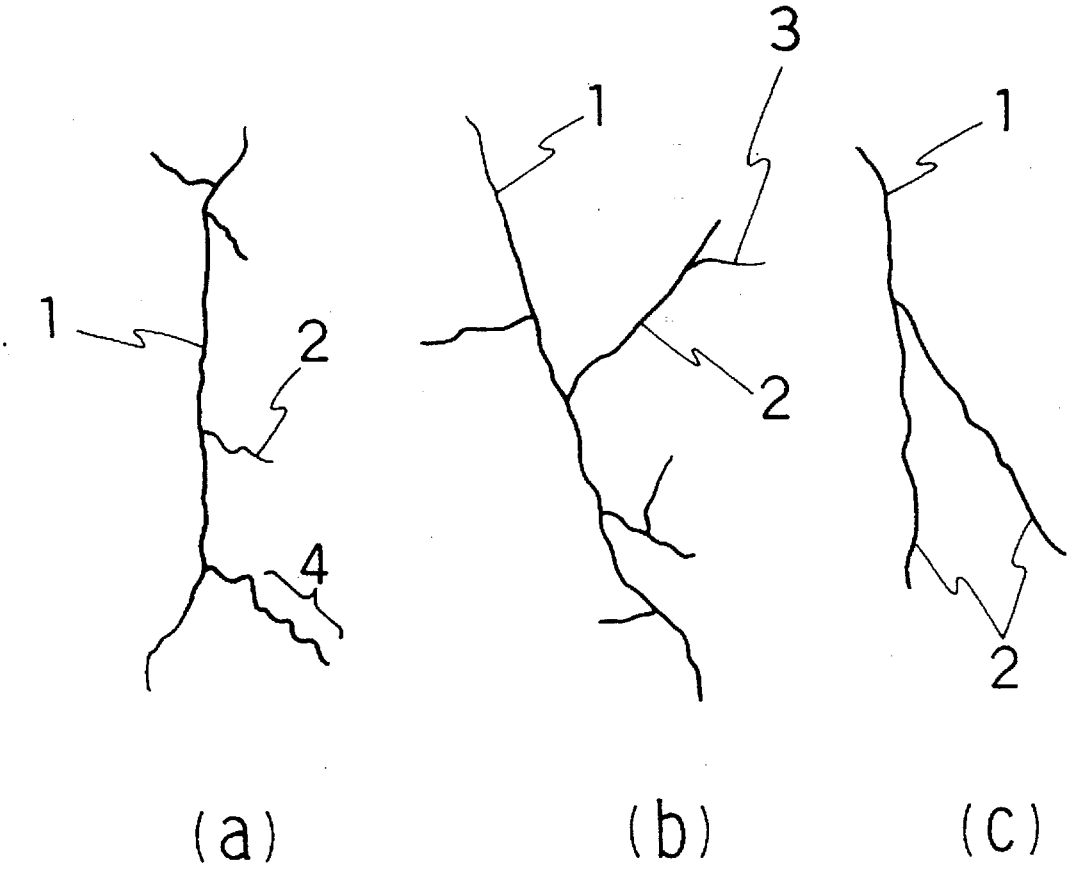
FIG. 1 is a diagrammatic view showing a branched structure of the PTFE fibers being contained in the cotton-like PTFE materials of the present invention.

The branched structure can be illustrated as shown in FIG. 1. The branched structure (a) indicates a fiber 1 and a plurality of branches 2 coming from the fiber 1. (b) is a fiber having a branch 2 and further a branch 3 coming from the branch 2. (c) is a fiber simply divided into two branches. Those structures are only models of the fibers, and the fibers having the same structure are not found actually (FIG. 8 to 12). The number and the length of branches are not particularly limited, but the existence of such branches is an important cause of enhancing intermingling property of the fibers. It is preferable that there is one branch, particularly at least two branches per 5 cm of the fiber.

The fineness ranges from 2 to 200 deniers, preferably 2 to 50 deniers. As it can be seen from FIGS. 8 to 12 referred to hereinafter, the preferable cotton-like materials are obtained when the fineness of the fiber including branches is in the said range, though there is no fiber having the same fineness throughout the fiber. Therefore there is a case where a part of the fiber is out of the fineness of the above-mentioned range. Also in the cotton-like materials of the present invention in order not to make intermingling property worse, it is preferable that the content of the fibers having a fineness of less than 2 deniers or more than 200 deniers is minimized below 10%, particularly below 5%.

Also it is preferable that as shown in FIG. 1, the fiber 1 making the cotton-like materials of the present invention has partly a "crimp" 4. The "crimp" also contributes to enhancement of intermingling property. The preferable number of crimps is 1 to 15/20 mm. According to the process of production of the present invention, there occurs crimps even if no specific crimping process is applied.

The cross sectional figure of the fiber is not uniform because of tearing by a mechanical force, and this contributes to intermingling among the fibers.

The cotton-like PTFE materials of the present invention, being excellent in intermingling property, is suitable for spun yarn and non-woven fabrics.

The non-woven fabrics are produced by means of a needle punching machine, and then water jet needle machine after treating with a carding machine, but the prior PTFE fibers having a low friction coefficient and a large specific gravity, could not be treated in the same manner as the other polyolefine, and a mechanical strength thereof was relatively low.

Figure 6:
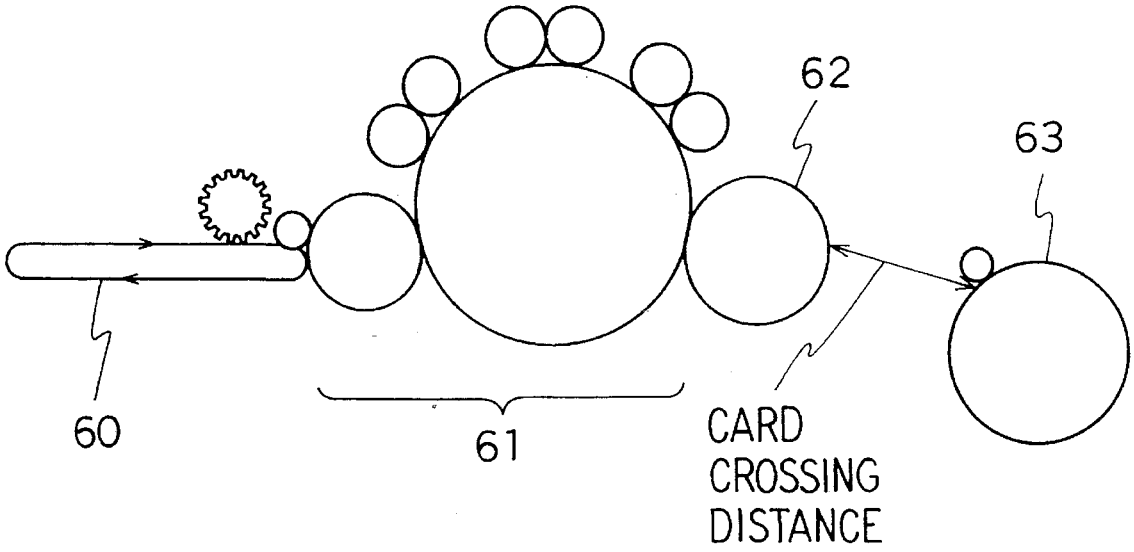
FIG. 6 is a diagrammatic sectional view of a hitherto known carding machine, which can be used for preparing a non-woven fabric from the cotton-like materials of the present invention.

For instance, in case of producing non-woven fabrics with a carding machine as shown in FIG. 6, the cotton-like materials (not illustrated) being transferred with a fiber mass conveyor 60 is passed through a carding machine 61, become webs, and then are wound on a drum 63 from a doffer 62. The carding machine (FIG. 6) used in the present invention is employed for polyolefine fibers such as polypropylene, and the distance (referred to as a "card crossing distance") between the doffer 62 and the drum 63 is set at about 28 cm. When the prior PTFE fibers were used, there occurred a dropping of the web between the doffer and the drum in case of that distance, and unless the distance is shortened up to about 5 cm, the web could not be wound on the drum.

When the cotton-like PTFE materials of the present invention are used, the web can be wound on the drum without any problem with the same card crossing distance (about 28 cm) as that of the cotton-like polyolefine materials.

The present invention is explained by means of Examples, but is not limited thereto.

EXAMPLE 1

PTFE fine powder (Polyflon F-104 available from Daikin Industries, Ltd., melting point of 345° C.) was paste-extruded and then calender-molded to obtain an unsintered tape (width of 200 mm, thickness of 100 μm) which was then heat-treated in an atmosphere at a temperature of 340° C. for 30 seconds to make a semi-sintered PTFE tape having a crystalline conversion ratio of 0.45.

Subsequently the semi-sintered tape was stretched between the No. 1 roll (roll diameter of 300 mm dia., temperature of 300° C., peripheral speed of 0.5 m/min.) and the No. 2 roll (roll diameter of 220 mm dia., temperature of 300° C., peripheral speed of 6.25 m/min.) by 12.5 times in the longitudinal direction, and a uniaxially stretched film of a semi-sintered PTFE was obtained.

Then one end of the uniaxially stretched film of the semi-sintered PTFE was fixed, and by means of a jig which has a rectangle of 20 cm by 5 cm on which 25 straight needles of 0.4 mm dia. by 5 mm long were provided per 1 $cm^2$, the film was torn forcibly and opened into pieces of fibers to obtain cotton-like materials.

The obtained cotton-like materials had the fibers of the following physical properties.

Fiber length: 5 to 243 mm, 88% was 5 to 150 mm.

Number of branches: 0 to 3 branches/5 cm, 32% was not less than 1 branch/5 cm.

Fineness: 2 to 462 deniers, 93% was 2 to 200 deniers.

Number of crimps: 0 to 3/20 mm, 28% of the fibers was 1 to 15/20 mm (excluding the crimps on the branches).

Shape of section: Not uniform.

The measurement of the above-mentioned physical properties were made in the following manner. (Fiber length and number of branches)

A hundred pieces of fibers were sampled at random and measured the fiber length and the number of branches. (Shape of section)

The shape of section of the bundle of fibers sampled at random were measured with a scanning electron microscope. (Fineness)

A hundred pieces of fibers sampled at random were used to measure the fineness thereof with an electronic fineness measuring equipment (available from Search Co., Ltd.) which utilizes a resonance of the fiber for measurement.

The equipment could measure the fineness of the fibers having the length of not less than 3 cm, and the fibers were selected irrespective of trunks or branches. But the fibers having, on the length of 3 cm, a large branch or many branches were excluded because they affects the measuring results. The equipment is capable of measuring the fineness in the range of 2 to 70 deniers, and so for the fibers having the fineness exceeding 70 deniers, the fineness thereof was obtained by a weight measurement.

(Number of crimps)

Measurement was made in accordance with the method of JIS L 1015 by means of an automatic crimp tester available from Kabushiki Kaisha Koa Shokai with a hundred pieces of fibers sampled at random (The crimps on the branch were not measured).

About 2% by weight of antistatic agents (Elimina available from Maruzen Yuka Kabushiki Kaisha) was sprayed onto the cotton-like materials comprising the sampled fibers, and the web was made with a carding machine (SC-360DR available from Kabushiki Kaisha Daiwa Kiko). The uniform web weighing 300 $g/m^2$ was easily made (card crossing distance of 28 cm).

Subsequently the web was placed on a woven fabric (Cornex CO1200 available from Teijin Ltd.), and needling was done with a needle punching machine (available from Kabushiki Kaisha Daiwa Kiko, 2,400 needles per 100 $cm^2$) to obtain the felted cloth.

EXAMPLE 2

(1) The PTFE fine powder (Polyflon F104U available from Daikin Industries, Ltd., melting point of 345° C.) was mixed with a lubricant (IP-2028, available from Idemitsu Sekiyu Kagaku Kabushiki Kaisha), and then aging was done at room temperature for 2 days and a preforming was conducted. The preformed article was paste-extruded and then calendered to make an unsintered film.

(2) The unsintered film was heat-treated for 53 seconds in a salt bath heated to 337° C., and the semi-sintered film having a width of 155 mm, thickness of 125 μm and a crystalline conversion ratio of 0.38 was obtained.

(3) The semi-sintered film was stretched by 15 times in the longitudinal direction by means of two rolls heated to 300° C. and having different rotation speed, and thus the uniaxially stretched film of 104 mm wide by 32 μm thick was obtained.

TABLE 1-continued

| Ex. No. | Process (2) | Process (3) | Process (4) |
|---|---|---|---|
| | 125 μm thick, Crystalline conversion ratio 0.38 | 104 mm wide, 32 μm thick | |
| 3 | 337° C., 45 seconds, 163 mm wide, 125 μm thick, Crystalline conversion ratio 0.31 | Heat treating at 320° C. for 10 seconds after stretching by 15 times at 300° C., 110 mm wide, 27 μm thick | v1 = 1.0 m/min. v2 = 1200 m/min. |
| 4 | 337° C., 49 seconds, 157 mm wide, 125 μm thick, Crystalline conversion ratio 0.34 | Heat treating at 340° C. for 30 seconds after stretching by 15 times at 300° C., 88 mm wide, 21 μm thick | v1 = 0.5 m/min. v2 = 1200 m/min. |

TABLE 2

| | Fiber length (mm) | | Number of branches (per 5 cm) | | Number of crimps (per 20 mm) | | Fineness (Denier) | | |
|---|---|---|---|---|---|---|---|---|---|
| Ex. No. | Total | 5 to 150 mm long (%) | Total | Not less than 1 branch/5 cm (%) | Total | 1 to 15 crimps/ 20 mm (%) | Total | 2 to 200 deniers (%) | Shape of section |
| 1 | 5 to 243 | 88 | 0 to 3 | 32 | 0 to 3 | 28 | 2 to 462 | 93 | Not uniform |
| 2 | 1 to 103 | 68 | 0 to 10 | 51 | 0 to 4 | 89 | 2 to 103 | 100 | Not uniform |
| 3 | 1 to 97 | 65 | 0 to 10 | 47 | 0 to 5 | 90 | 3 to 96 | 100 | Not uniform |
| 4 | 1 to 92 | 59 | 0 to 9 | 49 | 0 to 5 | 83 | 3 to 105 | 100 | Not uniform |

(4) The obtained uniaxially stretched film was opened by tearing by means of a roll wound with a garnet wire and rotating at high speed as shown in FIG. 2, and the cotton-like materials were obtained. The garnet wire used had five blades per 1 inch and a 1 mm thick wire. The film feed speed (v1) was 1.5 m/min. and the peripheral speed (v2) of the roll was 1200 m/min.

The obtained cotton-like materials comprised the fibers having the following physical properties.

Fiber length: 1 to 103 mm, 68% was 5 to 150 mm.

Number of branches: 0 to 10 branches/5 cm, 51% was not less than 1 branch/5 cm.

Fineness: 2 to 103 deniers, 100% was 2 to 200 deniers.

Number of crimps: 0 to 4/20 m mm, 89% of the fibers had 1 to 15/20 mm.

Figure 7:
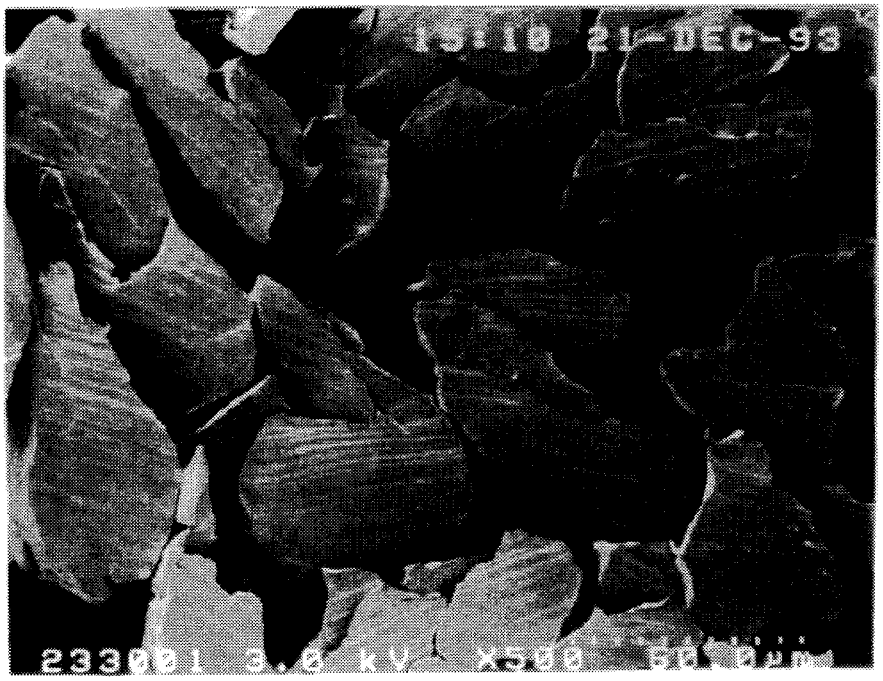
FIG. 7 is a scanning type electron microscope photograph (×500) of a section of the fiber prepared in Example 2 of the present invention.
Figure 8:
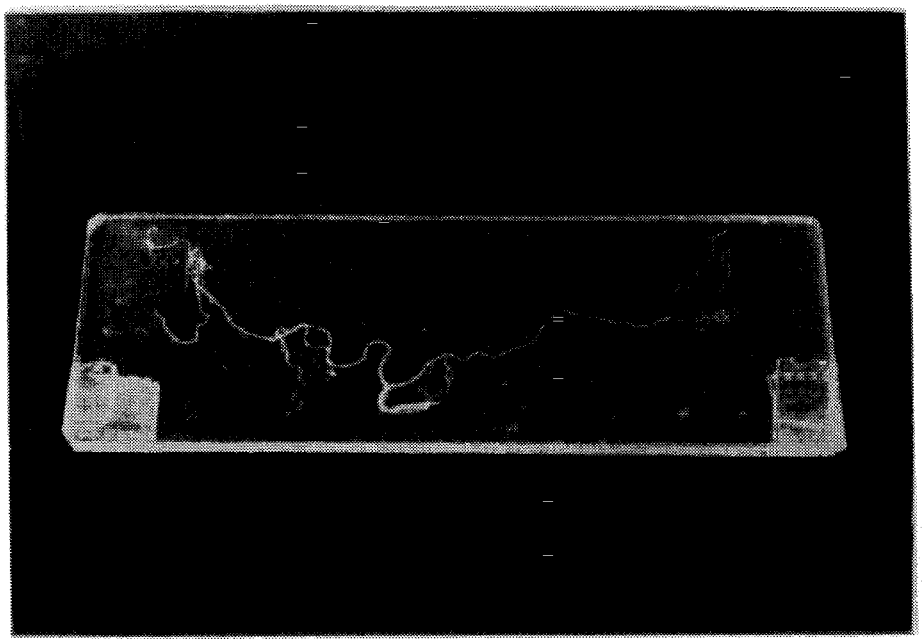
FIGS. 8 to 12 are photos (×1.5) of the fibers obtained in Example 5 of the present invention.
Figure 9:
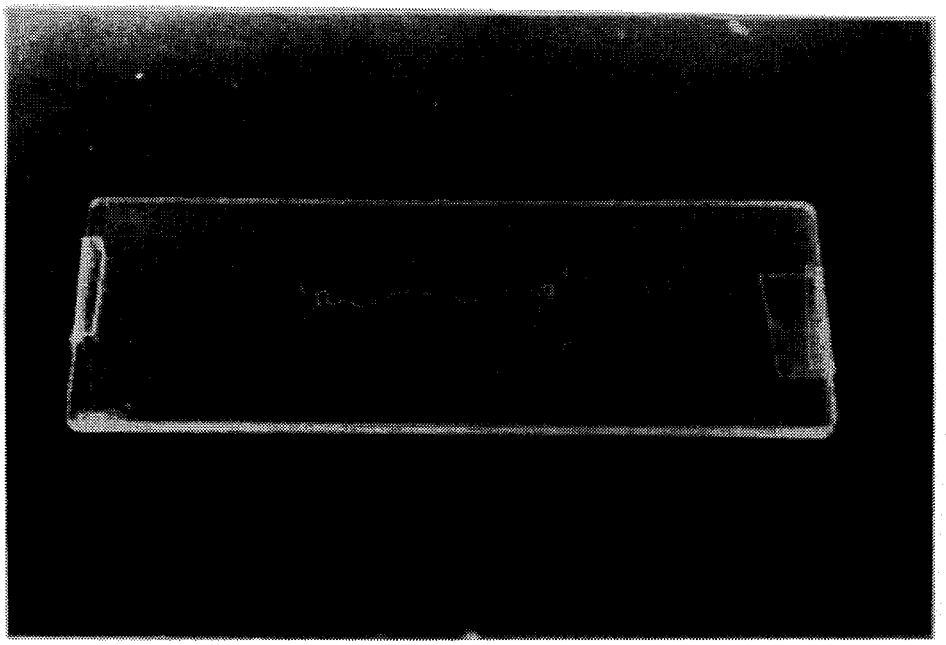
Figure 10:
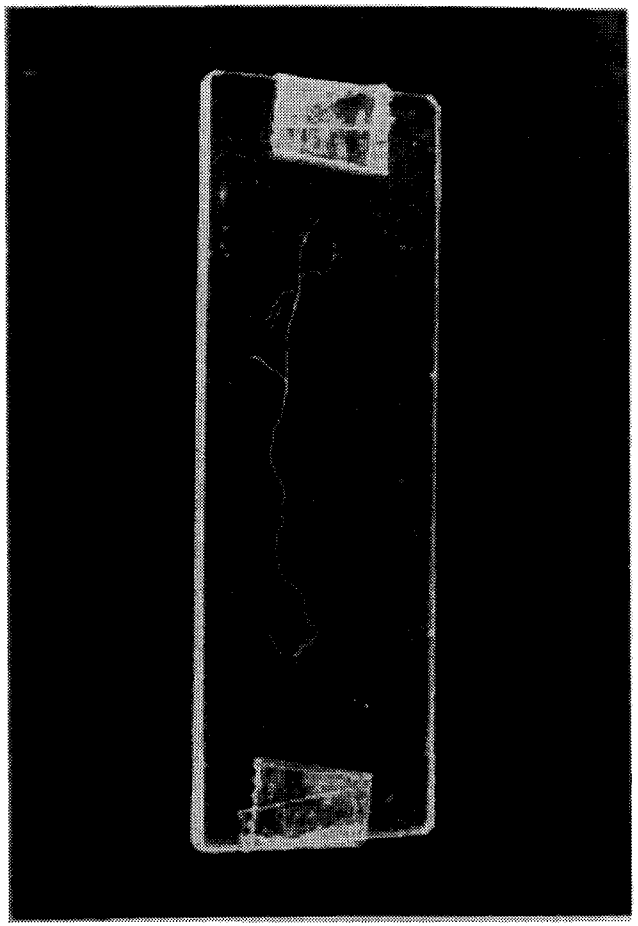
Figure 11:
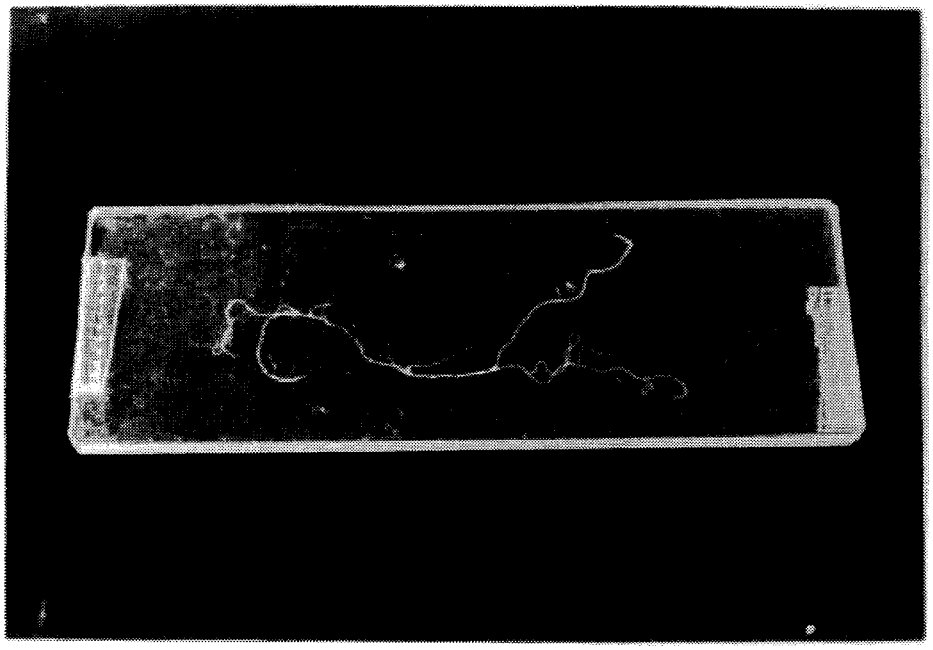
Figure 12:
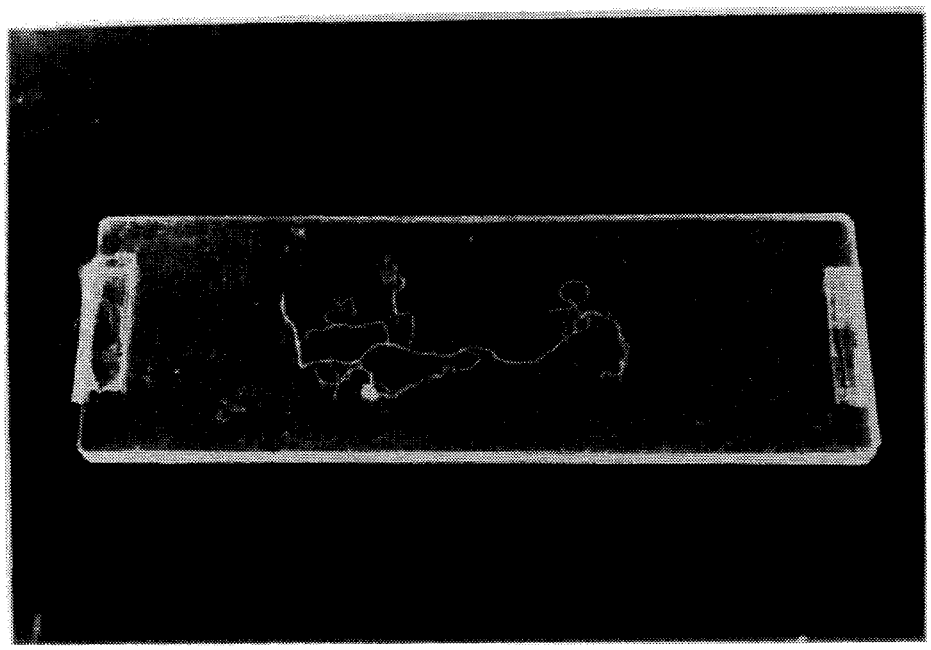

Shape of section: Not uniform (FIG. 7 shows the shape of section of the fibers (×500))

EXAMPLES 3 and 4

The cotton-like PTFE materials were obtained in the same manner as in Example 2 except that the processes (2) to (4) of Example 2 were changed as shown in Table 1. The physical properties of the fibers contained therein were examined in the same manner as in Example 2. The results are given in Table 2.

TABLE 1

| Ex. No. | Process (2) | Process (3) | Process (4) |
|---|---|---|---|
| 2 | 337° C., 53 seconds, 155 mm wide, | Stretching by 15 times at 300° C., | v1 = 1.5 m/min. v2 = 1200 m/min. |

EXAMPLE 5

(1) The PTFE fine powder (Polyflon F104U available from Daikin Industries, Ltd.) was mixed with a lubricant (IP-2028, available from Idemitsu Sekiyu Kagaku Kabushiki Kaisha), and then aging was done at room temperature for 2 days and a preforming was conducted. The preformed article was paste-extruded and then calendered to make an unsintered film.

(2) The unsintered film was heat-treated for 60 seconds in a salt bath heated to 360° C., and the sintered film having a width of 155 mm and thickness of 60 μm was obtained.

(3) The sintered film was stretched by 4 times in the longitudinal direction by means of two rolls heated to 320° C. and having different rotation speed, and thus the uniaxially stretched film of 85 mm wide and 24 μm thick was obtained.

(4) The uniaxially stretched film was torn and opened by means of a pair of upper and lower needle blade rolls as shown in FIG. 3 with a film feed speed (v3) of 1.6 m/min., a peripheral speed (v4) of 48 m/min. of the needle blade rolls and a speed ratio of v4/ v3 of 30 times, and the opposite side (delivery portion of the opened fibers) of a film feed-in section was pressure-reduced. Thus the cotton-like materials were obtained.

Figure 4:
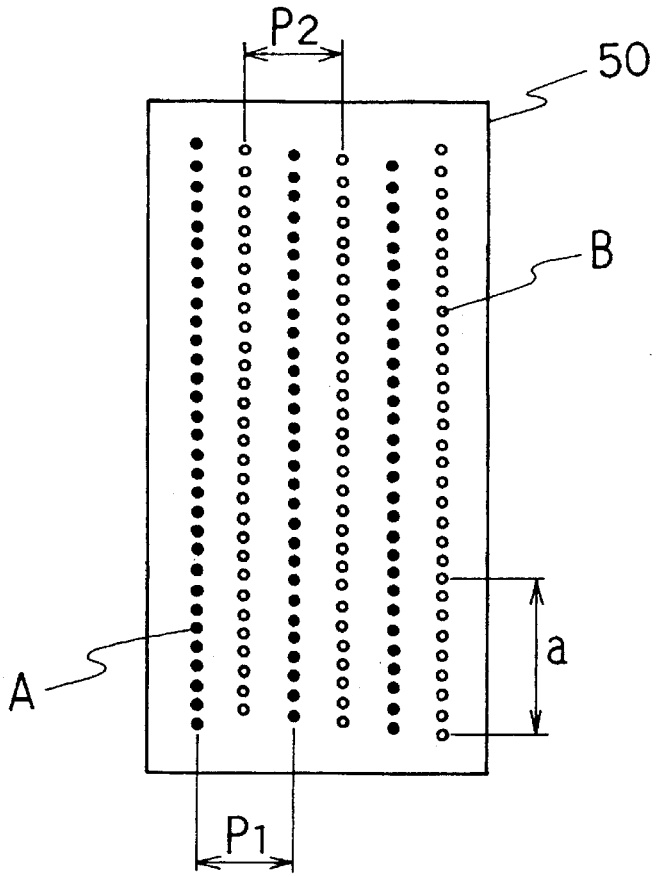
FIG. 4 is an explanatory view showing an example of an arrangement of needle blades on the roll surface of an opening machine shown in FIG. 3.
Figure 5:
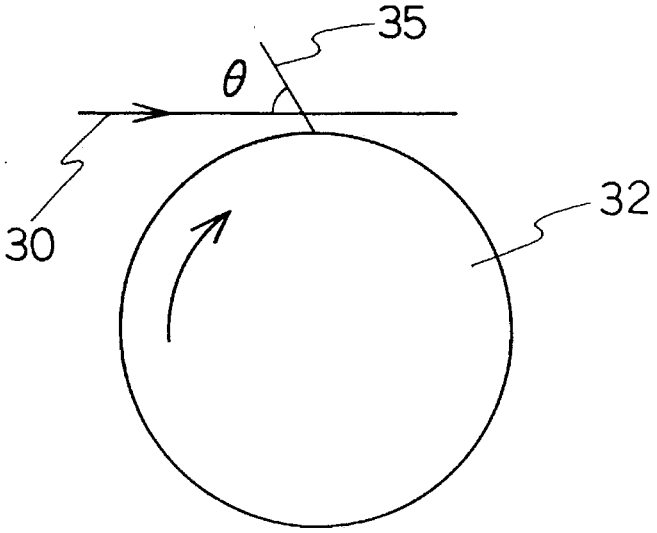
FIG. 5 is a diagrammatic sectional view explaining an angle (θ) of a needle of the needle blade of an opening machine shown in FIG. 3.

The shape of the needle blade rolls, and the arrangement and engagement of the blades of the upper and lower needle blade rolls are as mentioned below. When the film 30 was passed at the same speed as a rotation of a pair of upper and lower needle blade rolls 31 and 32 of FIG. 3, the punched film as shown in FIG. 4 was obtained. In FIG. 4, A is a needled hole of the upper needle blade roll 31, and the pitch P1 of the holes in the circumferential direction was 2.5 mm. B is a needled hole of the lower needle blade roll 32, and the pitch P2 thereof was 2.5 mm just like P1. The number "a" of needles in the longitudinal direction of the roll was 13 per 1 m. Also as shown in FIG. 5, the angle (θ) of the needle to the film 30 being fed between the rolls 31 and 32 was so set as to be an acute angle (60°). The upper and lower needle blade rolls 31 and 32 were so set that the needles of the upper and lower rolls were arranged alternately in the circumferential direction of the rolls. The length of the needle blade rolls was 250 mm, and the diameter of the rolls was 50 mm at the ends thereof.

(5) The physical properties of the obtained fibers were measured in the same manner as in Example 1. The results are given in Table 4.

Figure 13:
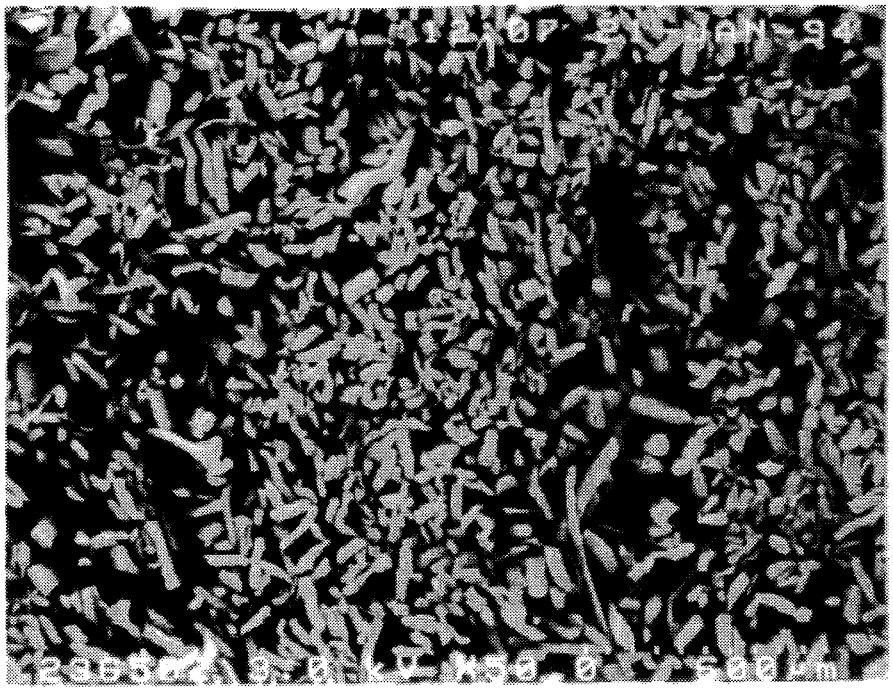
FIG. 13 is a scanning type electron microscope photograph (×50) of a section of the fiber obtained in Example 5 of the present invention.

(6) FIGS. 8 to 12 are photos (×1.5) showing the shapes of the obtained fibers, and FIG. 13 shows the shape (×50) of the section of the obtained fibers.

Examples 6 and 7

The cotton-like PTFE materials were obtained in the same manner as in Example 5 except that the processes (2) to (4) of Example 5 were changed as shown in Table 3. The physical properties of the fibers contained in the cotton-like materials were examined in the same manner as in Example 5. The results are given in Table 4.

TABLE 3

| Ex. No. | Process (2) | Process (3) | Process (4) |
|---|---|---|---|
| 5 | 360° C., 60 seconds, 155 mm wide, 60 μm thick, Crystalline conversion ratio 1.0 | Stretching by 4 times at 320° C., 85 mm wide, 24 μm thick | v3 = 1.6 m/min. v4 = 48 m/min. v4/v3 ratio: 30 |
| 6 | 337° C., 48 seconds, 157 mm wide, 125 μm thick, Crystalline conversion ratio 0.33 | Heat treating at 360° C. for 1 minute after stretching by 15 times at 300° C., 80 mm wide, 17 μm thick | v3 = 1.6 m/min. v4 = 48 m/min. v4/v3 ratio: 30 |
| 7 | 360° C., 62 seconds, 155 mm wide, 90 μm thick, Crystalline conversion ratio 1.0 | Heat treating at 340° C. for 30 seconds after stretching by 5 times at 320° C., 90 mm wide, 43 μm thick | v3 = 1.6 m/min. v4 = 48 m/min. v4/v3 ratio: 30 |

Daiwa Kiko) as shown in FIG. 6. Thus the web having a weight of 450 g/m$^2$ could be obtained. At that time, the revolutions of the cylinder, doffer and drum were 180 rpm, 6 rpm and 5 rpm, respectively, and the card crossing distance was 28 cm.

(2) The obtained web was placed on a woven fabric (a base fabric) of Cornex CO1200 (available from Teijin Ltd.), and needling was done by means of a needle punching machine (available from Kabushiki Kaisha Daiwa Kiko) with 25 needles/cm$^2$. Thus the needle-punched non-woven fabric was obtained.

An air permeability of the obtained needle punched non-woven fabric was measured to be 27 cm$^3$/cm$^2$/sec. (Air permeability)

Measurement was carried out with a Frazier type air permeability tester.

EXAMPLE 9

(1) By the use of Cornex CO1200 (available from Teijin Ltd.) on the feed belt in FIG. 2 of Example 2, the web could be obtained at a weight of 350 g/m$^2$ on the feed belt.

(2) The obtained web was subjected to water jet needling with a water jet needle equipment (available from Perfojet Co., Ltd.), and the non-woven fabric using a base fabric of Cornex CO1200 was made.

In that case, the nozzles of the water jet needle were so arranged that 800 nozzles having 100 μm diameter were set at an interval of 1 mm in the transverse direction and at three rows in the longitudinal direction. The ejection pressure was 40 kg/cm$^2$, 100 kg/cm$^2$ and 130 kg/cm$^2$ at the first, second and third rows, respectively.

(3) The air permeability of the non-woven fabric which was subjected to water jet needling was measured in the same manner as in Example 8, and was 18 cm$^3$/cm$^2$/sec.

EXAMPLE 10

(1) In the same manner as in (1) of Example 8, the cotton-like materials obtained in Example 3 were passed through the carding machine, and the web having a weight of 350 g/m$^2$ could be made (card crossing distance of 28 cm).

(2) The obtained web was placed on the woven fabric (a base fabric) of Cornex CO1200 (available from Teijin Ltd.), and then needled by means of a needle punching machine (available from Kabushiki Kaisha Daiwa Kiko) with 25 needles/cm$^2$. Thus the needle-punched non-woven fabric was made.

(3) The air permeability of that non-woven fabric was 30 cm$^3$/cm$^2$/sec.

TABLE 4

| | Fiber length (mm) | | Number of branches (per 5 cm) | | Number of crimps (per 20 mm) | | Fineness (Denier) | | |
|---|---|---|---|---|---|---|---|---|---|
| Ex. No. | Total | 5 to 150 mm long (%) | Total | Not less than 1 branch/5 cm (%) | Total | 1 to 15 crimps/ 20 mm (%) | Total | 2 to 200 deniers (%) | Shape of section |
| 5 | 21 to 215 | 92 | 0 to 8 | 84 | 0 to 9 | 91 | 2 to 48 | 100 | Not uniform |
| 6 | 27 to 187 | 94 | 0 to 9 | 88 | 0 to 6 | 89 | 2 to 42 | 100 | Not uniform |
| 7 | 31 to 221 | 90 | 0 to 8 | 85 | 0 to 10 | 92 | 3 to 63 | 100 | Not uniform |

EXAMPLE 8

(1) About 2% by weight of antistatic agent Elimina (available from Maruzen Yuka Kabushiki Kaisha) was sprayed onto the cotton-like materials obtained in Example 2, and then the materials were passed through the carding machine (SC-360DR, available from Kabushiki Kaisha

EXAMPLE 11

(1) By the use of Cornex CO1200 (available from Teijin Ltd.) on the feed belt in FIG. 2 of Example 3, the web could be obtained at a weight of 350 g/m$^2$ on the feed belt.

(2) The obtained web was subjected to water jet needling with a water jet needling equipment (available from Perfojet Co., Ltd.), and the non-woven fabric using a base fabric of Cornex CO1200 was made.

In that case, the nozzles of the water jet needle were so arranged that 800 nozzles having 100 μm diameter were set at an interval of 1 mm in the transverse direction and at three rows in the longitudinal direction. The ejection pressure was 40 kg/cm$^2$,100 kg/cm$^2$ and 130 kg/cm$^2$ at the first, second and third rows, respectively.

(3) The air permeability of that non-woven fabric was 18 cm$^3$/cm$^2$/sec.

EXAMPLE 12

(1) In the same manner as in (1) of Example 8, the cotton-like materials obtained in Example 4 were passed through the carding machine, and the web having a weight of 350 g/m$^2$ could be obtained (card crossing distance of 28 cm).

(2) The obtained web was placed on the woven fabric (a base fabric) of Cornex CO1200 (available from Teijin Ltd.), and then needled by means of a needle punching machine (available from Kabushiki Kaisha Daiwa Kiko) with 25 needles/cm$^2$. Thus the needle-punched non-woven fabrics were made.

(3) The air permeability of those non-woven fabrics was 33 cm$^3$/cm$^2$/sec.

EXAMPLE 13

(1) By the use of Cornex CO1200 (available from Teijin Ltd.) on the feed belt in FIG. 2 of Example 4, the web could be obtained at a weight of 350 g/m$^2$ on the feed belt.

(2) The obtained web was subjected to water jet needling with a water jet needling equipment (available from Perfojet Co., Ltd.), and the non-woven fabric using a base fabric of Cornex CO1200 was made.

In that case, the nozzles of the water jet needle were so arranged that 800 nozzles having 100 μm diameter were set at an interval of 1 mm in the transverse direction and at three rows in the longitudinal direction. The ejection pressure was 40 kg/cm$^2$, 100 kg/cm$^2$ and 130 kg/cm$^2$ at the first, second and third rows, respectively.

(3) The air permeability of that non-woven fabric was 20 cm$^3$/cm$^2$/sec.

EXAMPLE 14

(1) In the same manner as in (1) of Example 8, the cotton-like materials obtained in Example 5 were passed through the carding machine, and the web having a weight of 350 g/m$^2$ could be obtained (card crossing distance of 28 cm).

(2) The obtained web was placed on the woven fabric (a base fabric) of Cornex CO1200 (available from Teijin Ltd.), and then needled by means of a needle punching machine (available from Kabushiki Kaisha Daiwa Kiko) with 25 needles/cm$^2$. Thus the needle-punched non-woven fabrics were made.

(3) The air permeability of those non-woven fabrics was 38 cm$^3$/cm$^2$/sec.

EXAMPLE 15

(1) In the same manner as in (1) of Example 8, the cotton-like materials obtained in Example 6 were passed through the carding machine, and the web having a weight of 350 g/m$^2$ could be obtained (card crossing distance of 28 cm).

(2) The obtained web was placed on the woven fabric (a base fabric) of Cornex CO1200 (available from Teijin Ltd.), and then needled by means of a needle punching machine (available from Kabushiki Kaisha Daiwa Kiko) with 25 needles/cm$^2$. Thus the needle-punched non-woven fabrics were made.

(3) The air permeability of those non-woven fabrics was 36 cm$^3$/cm$^2$/sec.

EXAMPLE 16

(1) In the same manner as in (1) of Example 8, the cotton-like materials obtained in Example 7 were passed through the carding machine, and the web having a weight of 350 g/m$^2$ could be obtained (card crossing distance of 28 cm).

(2) The obtained web was placed on the woven fabric (a base fabric) of Cornex CO1200 (available from Teijin Ltd.), and then needled by means of a needle punching machine (available from Kabushiki Kaisha Daiwa Kiko) with 25 needles/cm$^2$. Thus the needle-punched non-woven fabrics were made.

(3) The air permeability of those non-woven fabrics was 39 cm$^3$/cm$^2$/sec.

Comparative Example 1

The Toyoflon® type 201 available from Toray Fine Chemical Kabushiki Kaisha, which is a staple fiber made by an emulsion sipnning method and has a fiber length of 70 mm and a fineness of 6.7 deniers (when measured in the same manner as in Example, the number of crimps was 7/20 mm, the number of branches is zero, and the section was in the circular form), was passed through the carding machine in the same manner as in (1) of Example 8. In the case of a card crossing distance of 28 cm, there occurred a dropping of the web, and the web could not be wound on the drum.

INDUSTRIAL APPLICABILITY

With the use of PTFE fibers of the present invention, which are excellent in intermingling property, and cotton-like PTFE materials comprising the PTFE fibers, there can be provided non-woven PTFE fabrics making the best use of excellent characteristics of PTFE.

We claim:

1. Polytetrafluoroethylene materials including branched polytetrafluoroethylene fibers having a length of about 1 to about 250 mm.

2. Branched polytetrafluoroethylene fibers having a length of about 5 to about 150 mm, and obtained by opening a uniaxially stretched article of molded polytetrafluoroethylene by a mechanical force.

3. The fibers of claim 2, having a fineness of 2 to 200 deniers.

4. The fibers of claim 2, wherein the branched polytetrafluoroethylene fibers are made of a semi-sintered polytetrafluoroethylene.

5. The fibers of claim 2, wherein the branched polytetrafluoroethylene fibers are made of a sintered polytetrafluoroethylene.

6. The materials of claim 1, wherein the branched polytetrafluoroethylene fibers are contained in an amount of not less than 30% of the total materials.

7. A process for preparing polytetrafluoroethylene materials including branched polytetrafluoroethylene fibers having a length of about 1 to about 250 mm which comprises tearing a uniaxially stretch article of molded polytetrafluoroethylene by contacting the stretched article with a rotating drum having an outer surface with sharp projections and thereby forming the branched polytetrafluoroethylene fibers.

8. The process for preparation of claim 7, wherein the branched polytetrafluoroethylene fibers are contained in an amount of not less than 30% of the total materials.

9. The process for preparation of claim 7, wherein the branched polytetrafluoroethylene fibers are made from a semi-sintered polytetrafluoroethylene with a ratio of uniaxial stretching of at least 6 times the original length.

10. The process for preparation of claim 7, wherein the branched polytetrafluoroethylene fibers are made from a sintered polytetrafluoroethylene with a ratio of uniaxial stretching of at least 3 times the original length.

11. The process for preparation of claim 7, wherein the preparing polytetrafluoroethylene materials including branched polytetrafluoroethylene fibers, which comprises tearing a uniaxially stretched article of polytetrafluoroethylene by passing the stretched article through at least a pair of needle blade rolls rotating at high.

12. The process for preparation of claim 7, wherein the the molded polytetrafluoroethylene is uniaxially stretched at 250° C. to 320° C., and the stretched article is torn after heat treating at a temperature of not less than the temperature of uniaxial stretching.

13. The polytetrafluoroethylene materials of claim 1, wherein the branched polytetrafluoroethylene fibers have a fineness of 2 to 200 deniers.

14. The polytetrafluoroethylene materials of claim 1, wherein the branched polytetrafluoroethylene fibers have the number of crimps of 1 to 15 crimps/20 mm.

15. The polytetrafluoroethylene materials of claim 1, wherein the branched polytetrafluoroethylene fibers are made of a semi-sintered polytetrafluoroethylene.

16. The polytetrafluoroethylene materials of claim 1, wherein the branched polytetrafluoroethylene fibers have a length of about 5 to about 150 mm.

17. The process of claim 7, wherein the branched polytetrafluoroethylene fibers have a length of about 5 to about 150 mm.

18. The fibers of claim 2, having the number of crimps of 1 to 15 crimps/20 mm.

* * * * *